US005635340A

United States Patent [19]

Mano et al.

[11] Patent Number: 5,635,340

[45] Date of Patent: Jun. 3, 1997

[54] IMAGE FORMING METHOD

[75] Inventors: Shigeru Mano; Ichiroh Maeda; Ken Okauchi, all of Hino, Japan

[73] Assignee: Konica Corporation, Tokyo, Japan

[21] Appl. No.: 509,894

[22] Filed: Aug. 1, 1995

Related U.S. Application Data

[63] Continuation-in-part of Ser. No. 276,466, Jul. 18, 1994, abandoned.

[30] Foreign Application Priority Data

Jul. 19, 1993 [JP] Japan ..... 5-178138

[51] Int. Cl.[6] ..... G03C 7/18; G03C 7/04

[52] U.S. Cl. ..... 430/357; 430/7; 430/359; 430/369; 430/374; 430/503

[58] Field of Search ..... 430/357, 359, 430/7, 374, 369, 15; 350/77

[56] References Cited

U.S. PATENT DOCUMENTS 3,215,689 11/1965 Hellmig .

4,359,280 11/1982 Krause ..... 430/357

5,419,989 5/1995 Takimoto et al. ..... 430/5

*Primary Examiner*—Thorl Chea

*Attorney, Agent, or Firm*—Finnegan, Henderson, Farabow, Garrett & Dunner, L.L.P.

[57] ABSTRACT

A method of image formation using mask for exposure to form an image on photographic paper is disclosed. The mask is composed of transferred images of the dyes of yellow, cyan and magenta. The spectral absorption peak wavelength of the dye is set in a range close to the wavelength at the maximum value of each of the regular, orthochromatic and panchromatic spectral sensitivities of the photographic paper to be used. In the spectral absorption of cyan of the mask for exposure, the absorbance of the wavelength at the maximum value of each of the regular and orthochromatic spectral sensitivities of the photographic paper to be used, is set at a value not more than a predetermined value. In the spectral absorption of yellow of the mask for exposure, the absorbance of the wavelength at the maximal value of each of the orthochromatic and panchromatic spectral sensitivities of the photographic paper to be used, is set at a value not more than a predetermined value.

8 Claims, 7 Drawing Sheets

IMAGE FORMING METHOD

This is a Continuation-in-Part Application of U.S. patent application Ser. No. 08/276,466 filed on Jul. 18, 1994, abandoned.

FIELD OF THE INVENTION

The present invention relates to an image forming method using a novel mask for exposure used for exposing and printing an image on photographic paper made of sliver halide color photosensitive material. More particularly, the present invention relates to the method using a novel color mask for exposure being made easily and having the most appropriate spectral absorption for printing an image on photographic paper.

BACKGROUND OF THE INVENTION

Conventionally, a silver salt photography type mask for exposure is used for printing an image on photographic paper. In general, the mask used conventionally is the silver halide photosensitive material (for example, Clear QA manufactured by Konica Co.) for that being used in order to view an image while the image is illuminated from the reverse side. This material has a transparent support, and non-image formed portion of this material after development is not-colored and transparent.

However, when the aforementioned silver halide photosensitive material is used, gradation of the obtained image is high. Therefore, illustrations and characters can be excellently printed on photographic paper, however, the quality of a natural image can not be satisfactorily high. For this reason, it is necessary to separately prepare a mask for exposure in which silver halide photosensitive material having a gradation property appropriate for a natural image is used. It is also required that an image printed on photographic paper is close to a designed image.

Furthermore, when silver halide photosensitive material is used for the mask for exposure, this mask for exposure is restricted by the coupling and developing properties of dyes of which color is in accordance with the combination of a coupler and developing agent. Therefore, it is difficult to design a photosensitive material, the irregular absorption of which is small.

SUMMARY OF THE INVENTION

The present invention has been achieved to solve the above problems. It is an object of the present invention to provide a mask for exposure having an excellent color reproducing property and being prepared easily. It is another object of the present invention to provide a mask for exposure of the digital image forming system in which the gradation property can be easily controlled. It is still another object of the present invention to provide an image forming method in which the above mask for exposure is used so as to form an image on photographic paper.

In the case of printing an image on photographic paper, the color reproducing property is greatly improved when the spectral absorption characteristics of yellow, magenta and cyan of a mask for exposure are appropriately selected.

In the mask for exposure of the present invention used for printing an image on sliver halide photosensitive material, such as a photographic paper, the spectral absorption peak wavelength of each dye of the mask for exposure composed of each dye image of yellow, magenta and cyan, is determined to be close to the maximum wavelength of each of regular (blue), orthochromatic (green) and panchromatic (red) sensitivities of photographic paper to be used. Absorbance of spectral absorption of the cyan dye of the mask for exposure is determined to be not more than a predetermined value at the maximum wavelength of each spectral sensitivity of regular (blue) and orthochromatic (green) sensitivities of photographic paper to be used. Absorbance of spectral absorption of the yellow dye of the mask for exposure is determined to be not more than a predetermined value at the maximal wavelength of each spectral sensitivity of orthochromatic (green) and panchromatic (red) sensitivities of photographic paper to be used. It is preferable that this mask for exposure is made by means of a sublimation type thermal transfer.

The mask can contain characters and illustration, and further a natural image. An image can be formed on photographic paper using a silver salt negative film together with the mask for exposure. The negative film general colored orange by the presence of the masking coupler in non-imaged portion compared with aforementioned clear QA, for example. In this case, the silver salt negative film provides a natural image and the mask provides an illustration or characters. Also, in case that the mask contains a natural image as well as character or illustration, a composite image can be formed on photographic paper using only the mask for exposure.

DETAILED DESCRIPTION OF THE INVENTION

With reference to the accompanying drawings, the present invention will be described as follows.

Figure 7:
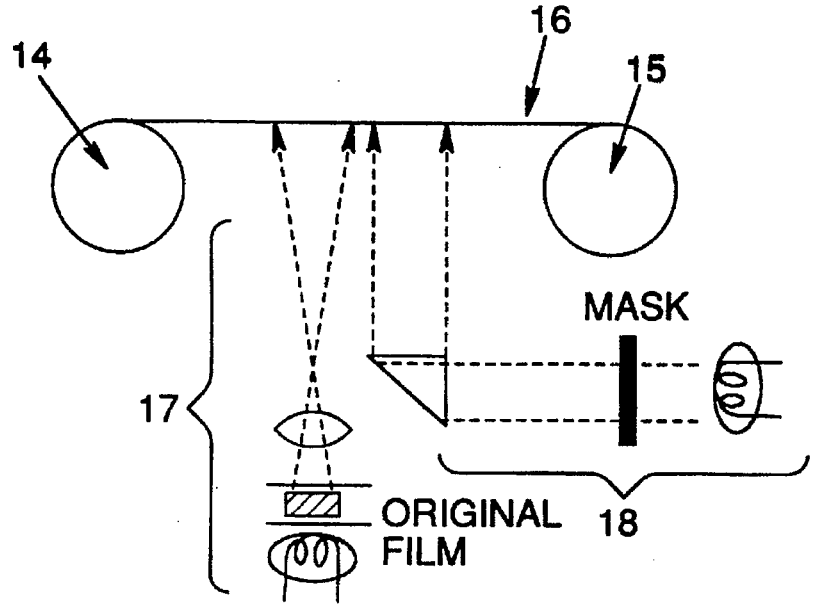
FIG. 7 is a schematic illustration of the printer.

FIG. 7 is a schematic illustration of the printer (the exposure) showing an example of the use of the mask. Numeral 14 is a supply roller for supplying photographic paper, numeral 15 is a photographic paper take-up roller for winding photographic paper after printing (exposing), numeral 16 is a sheet of photographic paper, and numeral 17 is a primary exposure unit. According to this printer, images on a silver salt photography negative film or an original of slide can be printed (exposed) on a sheet of photographic paper. Numeral 18 is a subsidiary exposure unit. The mask for exposure of the present invention is set on the subsidiary exposure unit 18, and the image can be printed (exposed) on photographic paper. Printing may be executed using both primary and subsidiary exposure so that the synthesized image is printed on photographic paper. Alternatively, only subsidiary exposure may be used so as to print (expose) an image on photographic sheet. An exposure by primary exposure unit 17 is not necessary when the mask is prepared so that it contains an image on the silver salt photography negative film or an original of slide. When a natural image is processed on the mask in the case where an area of the natural image is large, an amount of image information is increased. Therefore, it may take time to process the image on a computer, and a memory device of large capacity is required, and the cost may be raised. For this reason, it is preferable to selectively use an original such as a photographic negative film, and the mask of the present invention. Then, the printed (exposed) sheet of photographic paper is subjected to development so the image can be formed.

Figure 1:
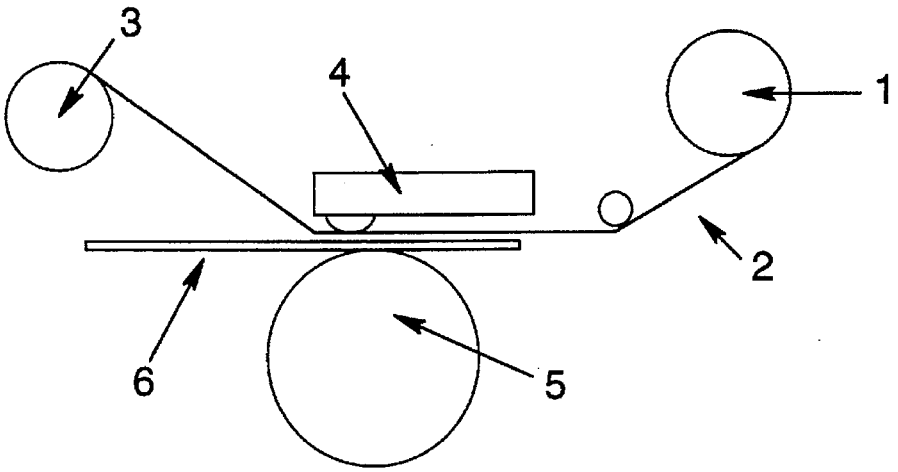
FIG. 1 is a conceptional view showing a thermal transfer recording apparatus by which an image is recorded on a transparent support for forming a mask.

FIG. 1 is a conceptional view showing a thermal transfer recording apparatus by which an image is recorded on a transparent support for forming a mask, the support having a transparent image receiving layer thereon. Numeral 1 is an ink sheet supply roller, numeral 2 is an ink sheet, numeral 3 is a take-up roller for winding a used ink sheet, numeral 4 is a thermal head, numeral 5 is a platen roller, and numeral 6 is a transparent image receiving sheet inserted between the thermal head and the platen roller.

The ink sheet 1 is successively coated with dyes of yellow, magenta and cyan of thermal diffusion type. A color image is formed in the following manner:

A surface of the ink sheet 1 on which ink is coated, is put on an image receiving layer side of the transparent image receiving sheet. When heat is given to the ink sheet by the thermal head, the thermal diffusion dye in the ink is moved to the image receiving layer on the transparent image receiving sheet in accordance with image data, so that a color image can be formed.

Figure 2:
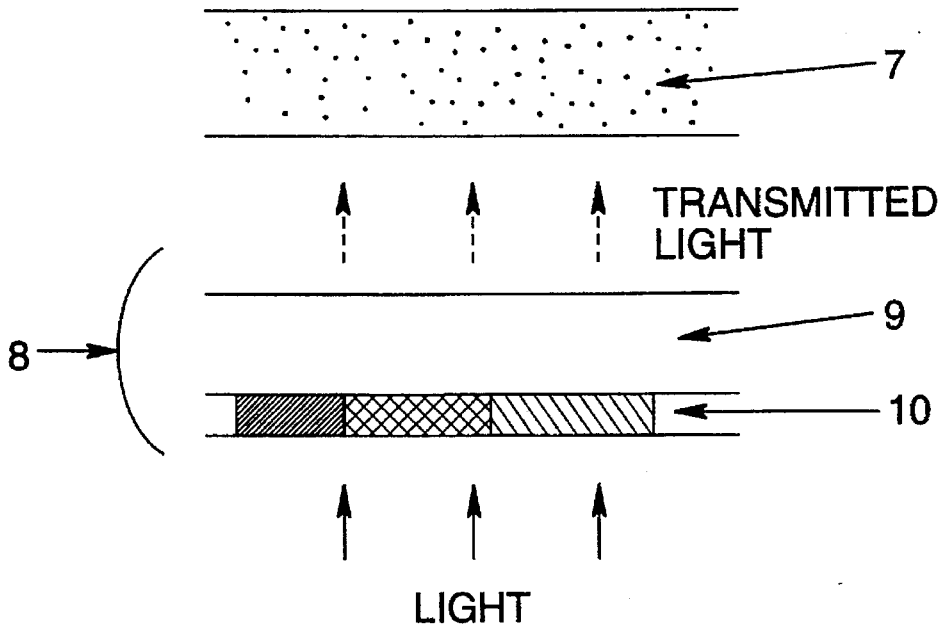
FIG. 2 is a sectional view showing a mask for exposure used for printing an image on photographic paper.

FIG. 2 is a sectional view showing a mask for exposure used for printing (exposing) an image on photographic paper. Also, FIG. 2 is a conceptional view showing the circumstances in which an image is printed (exposed) on photographic sheet. Numeral 7 is a sheet of photographic paper. Numeral 8 is a mask for exposure made in the manner described above. Numeral 9 is a transparent support. Numeral 10 is an image receiving layer on which a color image is formed. An image is formed (exposed) on the photographic sheet as follows:

Continuous light is incident on one side of the mask for exposure. Light is absorbed by the mask in accordance with the image pattern, and transmitted light is incident on the sheet of photographic paper, so that the image is formed (exposed) on the sheet. The thickness of the transparent support of the mask for exposure is usually 20–300 μm. From the viewpoint of handling property, the thickness of the transparent support of the mask for exposure is not less than 51 μm, and preferably not less than 75 μm.

In the invention, thermal diffusion dyes (preferably those fitting a sublimating thermal transfer method) are used for making a mask. For image forming employing thermal diffusion dyes for making the mask of the invention, it is possible to use known materials, constitution and image-forming methods in the manner wherein they fit the object of the invention.

1. Dye-receiving material

As a dye-receiving material, a sheet available on the market for OHP use, for example, can be used provided that the sheet comprises a transparent base material having an image receiving layer on at least one side of the sheet. It is also possible to prepare the sheet by combining the materials described as follows.

As a transparent base material, there may be given various plastic films made of resins such as polyvinylchloride, polystyrene, polyethyleneterephthalate, polybutyleneterephthalate, polyethylenenaphthalate, polyimide, polyetherimide, polycarbonate, polyetheretherketone, polyarylate, polysulfon, and polyethersulfon. Among the foregoing, a biaxial oriented film which is excellent in dimension stability is preferable. When using it as an original for a print, the transparent base material which shows transmittance of 90% or more for the transmitted light having a wavelength of 400–750 nm is preferable for eliminating color contamination caused by thermal diffusion dyes. For these base materials, polyethyleneterephthalate, polybutyleneterephthalate and polyethylenenaphthalate are preferable.

An image receiving layer in thermal diffusion dye transfer is only required to have capability of receiving thermal diffusion dyes. An image receiving layer suitable for thermal diffusion dye transfer can be formed by binder resins and, when necessary, by various additives.

As binder resins, it is possible to use the known resins which have been used for a layer that receives dye-receiving materials. For example, polyester resins, polyvinylacetal resins, urethane resins, amide resins, cellulose resins, olefin resins, vinylchloride resins, acryl resins, styrene resins, polycarbonate, polyvinylalcohol, polyvinylpyrrolidone, polysulfon, polycaproluctone resins, polyacrylonitrile resins, urea resins, epoxy resins and phenoxy resins may be given. These resins may be used independently or in combination of two types or more.

These binder resins described above are usually used at the rate of 20–99% by weight in compositions forming an image receiving layer, and the rate of 50–95% by weight is more preferable.

To the image receiving layer, there may be added release agents, antioxidants, IV-absorbing agents, light stabilizing agents, fillers (inorganic fine grains, organic resin grains), pigments and antistatic agents. Further, plasticizers and hot melt agents may be added to the image receiving layer as a sensitizing agent.

When forming thermal diffusion dye images, it is preferable that an image receiving layer contains release agents for the purpose of preventing fusion between an ink sheet and the image receiving layer.

Further, when an image is formed with chelated dyes described in Japanese Patent Publication Open to Public Inspection No. 78893/1984 (hereinafter referred to as Japanese Patent O.P.I. Publication), metal-containing compounds may be contained in an image receiving layer, and when an image is formed with dyes produced through the reaction of mordants and the dyes both contained in the image receiving layer or through the salt-exchange reaction, by the use of dyes having a phenolic hydroxyl group described in Japanese Patent O.P.I. Publication No.83685/1991 and others or dyes produced through formation of nitrogen-containing organic bases and salts both described in Japanese Patent O.P.I. Publication No.96868/1993 and others, mordants such as a quaternary ammonium salt or the like can be contained in an image receiving layer.

An added amount of all additives in an image receiving layer is preferably selected normally to be in a range of 0.1–30% by weight, and thickness of the image receiving layer is selected usually to the range of 1–20 μm and preferably to the range of 2–10 μm. The image receiving layer may be formed in either a single layer structure or a multi-layer structure wherein each layer is the same in terms of composition or two or more layers are different each other.

2. Ink sheet for thermal diffusion dye transfer

An ink sheet for thermal diffusion dye transfer is basically composed of a support on which an ink layer containing thermal diffusion dyes is laminated.

Any material which is stable dimensionally and is durable against heat during recording in a thermal head can be used as a support, and thin paper such as condenser paper and glassine paper, and heat-resistant plastic film such as polyethyleneterephthalate, polyethylenenaphthalate, polyamide, polyimide, polycarbonate, polysulfon, polyvinylalcoholcellophane and polystyrene can be used.

It is preferable that the thickness of a support is 2–10 μm.

An ink layer is composed of thermal diffusion dyes and binder resins both serve as essential components. Those suitable for the object of the invention among cyan dyes, magenta dyes, yellow dyes which have been used for example, can be used as thermal diffusion dyes.

Cyan dyes as those mentioned above include known naphthoquinone dyes, anthraquinone dyes, azomethine dyes and indoaniline dyes, magenta dyes mentioned above include anthraquinone dyes, azo dyes and azomethine dyes, and yellow dyes include methine dyes, azo dyes, quinophthalone dyes and anthraisothiazole dyes.

Dyes capable of chelating which are used in an image forming method wherein an image excellent in fixing property is formed with chelated dyes described in Japanese Patent O.P.I. Publication No.78893/1984, dyes used in a method wherein dyes having a phenol type hydroxyl group described in Japanese Patent O.P.I. Publication No.83685/1991 are used and an image is formed with dyes formed through reaction of mordants and the dyes both contained in an image receiving layer, and dyes used in a method wherein dyes formed through formation of both a nitrogen-containing organic base and a salt are used, and an image is formed through salt-exchange reaction of mordants and the dyes both contained in an image receiving layer, can also be used respectively in their appropriate form.

The dyes mentioned above are contained in ink layer forming compositions normally at the rate of 10–80% by weight and more preferably at the rate of 30–70% by weight.

As a binder of an ink layer, there may be given cellulose resins such as cellulose ester and cellulose ether, vinyl resins such as polyvinyl alcohol, polyvinylformal, polyvinyl acetoacetal, polyvinyl butyral, polyvinyl acetal resins, polyvinyl pyrrolidone, polyvinyl acetate, polyacrylamide, styrene resins, poly(metha)ester acrylate, poly(metha)acrylic acid and coplymers of (metha)acrylic acid, rubber resins, ionomer resins, olefin resins and polyester resins.

The binders mentioned above are contained in ink layer forming compositions normally at the rate of 20–90% by weight and more preferably at the rate of 70–30% by weight.

Various additives can be added properly to the above-mentioned ink layer.

The additives mentioned above may include, for example, silicone (denatured) resins, fluororesin, release compounds such as surfactants and wax, fillers such as metallic fine powder, metallic oxides and carbon black and resin powder, hardening agents capable of reacting on binder components (for example, isocyanates), antistatic agents and further hot melt substances for accelerating transfer, and compounds described in Japanese Patent O.P.I. Publication No.106997/1984 such as, for example, wax and higher fatty acid esters.

The additives mentioned above are contained in ink layer forming compositions normally at the rate of 0–30% by weight and more preferably at the rate of 0–20% by weight.

An ink sheet is not limited to a 2-layer structure comprising a support and an ink layer, but is allowed to be provided with other layers formed thereon.

For example, an over-coat layer may be provided on the surface of the ink layer as described in Japanese Patent O.P.I. Publication Nos. 48188/1984 and 224590/1985 for the purpose of preventing fusion with a thermal transfer recording/image-receiving sheet and dye blocking.

A support may further be provided thereon with a subbing layer as described in Japanese Patent O.P.I. Publication Nos. 124890/1984, 232996/1985 and 261090/1986 for the purpose of improving adhesion with an ink layer and preventing dye transfer to and dye dyeing on the support side.

A support may further be provided on its reverse side with a backing layer as described in Japanese Patent O.P.I. Publication Nos. 82387/1985, 94390/1985, 115488/1985, 184883/1985 and 219094/1985 for the purpose of securing running stability, heat resistance and antistatic property.

Each of the over-coat layer, the subbing layer and the backing layer normally has a thicness of 0.1–1 μm.

3. A method for preparing a mask of the invention

For the thermal diffusion dye image to be formed on a dye-receiving material, an ink layer of an ink sheet is superimposed on an image receiving layer of the dye-receiving material, and heat energy is given to them image-wise by a laser or a thermal head. Then, thermal diffusion dyes in the ink layer corresponding in terms of quantity to the given heat energy cause thermal diffusion and are transferred to the image on the image receiving layer. It is possible to change heat energy to be given continuously or stepwise in the thermal head by changing voltage to be impressed or modulating a pulse width.

Heat energy may be given either from the ink sheet side or from the dye-receiving material side. It may further be given from both sides. When the effective use of heat energy is preceded, it is preferable to give the heat energy from the ink sheet side.

After forming an image, heat treatment may be given for the purpose of further improvement of image lasting quality (especially, fixation property). For example, the entire surface for image forming may be subjected to heat treatment by means of a thermal head, using the portion without an ink layer on an ink sheet, or heat treatment by means of a heat roll may be given separately. When near infrared radiation absorbing agents are contained, an image forming surface may be subjected to exposure carried out by an infrared flash lamp.

When a protective layer is provided on a dye-receiving layer, it is possible to use a heat roll or a hot stamp both capable of heating and pressurizing.

Figure 3:
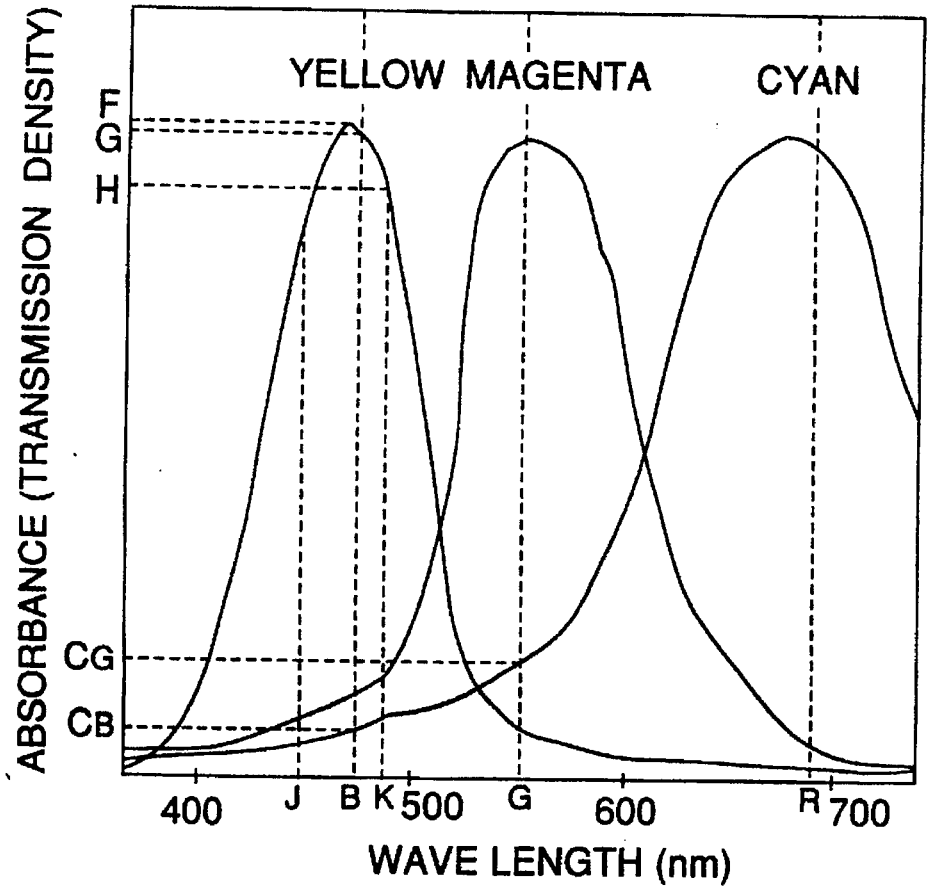
FIG. 3 is a conceptional view of the light transmission spectrum of the mask for exposure. The axis of ordinate expresses the absorbance of light (transmission density), and the axis of abscissa expresses the wavelength of light.

FIG. 3 is a conceptional view of the light transmission spectrum of the mask for exposure. The axis of ordinate expresses the absorbance of light (transmission density), and the axis of abscissa expresses the wavelength of light. The maximum values of regular (blue), orthochromatic (green) and panchromatic (red) spectral sensitivities of the photographic sheet are respectively $B_{nm}$, $G_{nm}$ and $R_{nm}$. The regular, orthochromatic and panchromatic layers of the photographic paper are defined as the sensitive layers respectively sensitive to blue, green and red light.

In order to derive the gradation expressing capacity from photographic paper, it is necessary that the transmission density of each of the colors of yellow, magenta and cyan of the mask for exposure is not less than 1.5, preferably not less than 1.7, and more preferably not less than 2.0 at the maximum wavelength of each of the regular (blue), orthochromatic (green) and panchromatic (red) spectral sensitivities of the photographic paper to be used.

The chroma of a formed image after development can be enhanced when the dyes of the mask for image exposure are selected so that the wavelength of each of the maximum regular (blue), orthochromatic (green) and panchromatic (red) spectral sensitivities of the photographic paper to be used is in the wavelength region in which the absorbance is not less than 80% of the maximum absorbance of each of yellow, magenta and cyan of the mask for exposure. Preferably, the chroma of the formed image can be enhanced when the dyes of the mask for image exposure are selected so that the wavelength of each of the maximum regular (blue), orthochromatic (green) and panchromatic (red) spectral sensitivities of the photographic paper to be used is in the wavelength region in which the absorbance is not less than 90% of the maximum absorbance of each of yellow, magenta and cyan of the mask for exposure.

One embodiment of the mask for exposure of the present invention is shown in FIG. 3, which will be described as follows:

As shown in FIG. 3, the wavelength $B_{nm}$ of maximum regular (blue) spectral sensitivity of the photographic paper to be used is in a wavelength range from $J_{nm}$ to $K_{nm}$, wherein this range shows the absorbance H which is not less than 80% of the maximum absorbance F of yellow of the mask for exposure. The maximum wavelength G of orthochromatic (green) spectral sensitivity of the photographic paper to be used is in a wavelength range which shows the absorbance not less than 80% of the maximum absorbance of magenta of the mask for exposure. The wavelength R of panchromatic (red) spectral maximum sensitivity of the photographic paper to be used is in a wavelength range which shows the absorbance not less than 80% of the maximum absorbance of cyan of the mask for exposure.

The grade of irregular absorption of the mask for exposure, and the quality of the formed image after development was evaluated, and the results are described as follows:

When the absorbance at the wavelength of the maximum orthochromatic (green) and panchromatic (red) spectral sensitivities of the photographic paper in yellow of the mask for exposure, is not more than 5% of the maximum absorbance of yellow of the transfer image on the mask, the color reproducing property is not affected, which is checked in the visual inspection. When the absorbance at the wavelength of the maximum orthochromatic (green) and regular (blue) spectral sensitivities of the photographic paper in cyan of the mask for exposure, is respectively not more than 20% and 5% of the maximum absorbance of cyan of the transfer image on the mask, the color reproducing property is not affected, which is the visual inspection.

A preferred embodiment of the mask for exposure of the present invention is described as follows:

The wavelength $B_{nm}$ at the maximum value of the regular (blue) spectral sensitivity of the photographic paper to be used is in a wavelength range from $J_{nm}$ to $K_{nm}$ showing the absorbance not less than 80% of the maximum absorbance F of yellow of the mask for exposure. Also, the absorbance of yellow of the mask at the wavelength $G_{nm}$ and $R_{nm}$ of the maximum orthochromatic (green) and panchromatic (red) spectral sensitivities of the photographic paper, is respectively not more than 5%. This embodiment is also shown in FIG. 3.

Another preferred embodiment of the present invention will be described below:

The wavelength $R_{nm}$at the maximum panchromatic (red) spectral sensitivity of photographic paper to be used is in a wavelength range in which the absorbance is not less than 80% of the maximum absorbance of cyan of the mask for exposure. Further, the absorbance of cyan of the mask for exposure of the wavelength $B_{nm}$, $G_{nm}$ at the maximum regular (blue) and orthochromatic (green) spectral sensitivities of photographic paper, is respectively not more than 5% and 20% of the maximum absorbance.

In the case of a mask for exposure made by the sublimation type thermal transfer method by which an image is formed when a dye coated on an ink sheet is moved by the action of heat into the receiving layer formed on the transparent support base, chemical changes are not required in the image forming process. For this reason, it is possible to make the primary absorption wavelength fit for the wavelength of the maximum regular (blue), orthochromatic (green) and panchromatic (red) spectral sensitivities of photographic paper, and it is also possible to select the dyes of yellow, magenta and cyan in which an amount of irregular absorption is small. Therefore, this mask for exposure is very excellent when it is used in the printing process of photographic paper. Further, when a digital image forming system is adopted, it is possible to make a mask for exposure using data in which image processing is executed in accordance with the type of an image (an natural image, illustration and character), attaching importance to gradation expression. Accordingly, it is possible to print a natural image and illustration of high quality. When an amount of heat supply is controlled, an amount of dye moving to the image receiving layer can be controlled. Therefore, absorbance necessary for a mask for exposure can be easily provided.

Examples of dye applicable to the invention are illustrated.

Yellow dye

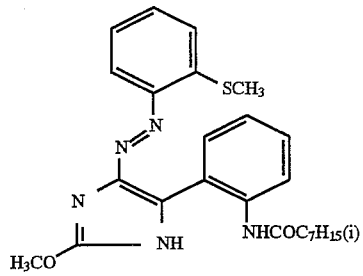

-continued

Magenta dye

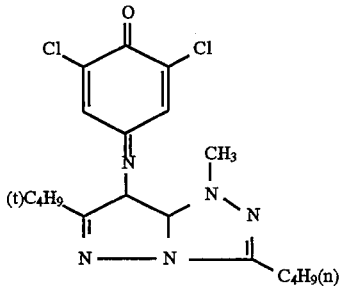

Cyan dye

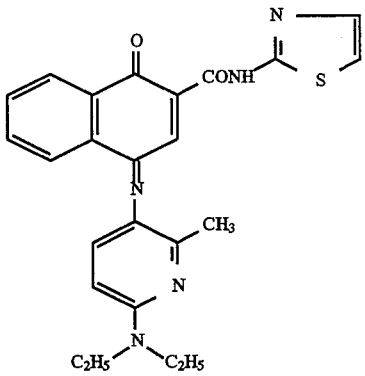

Figure 8:
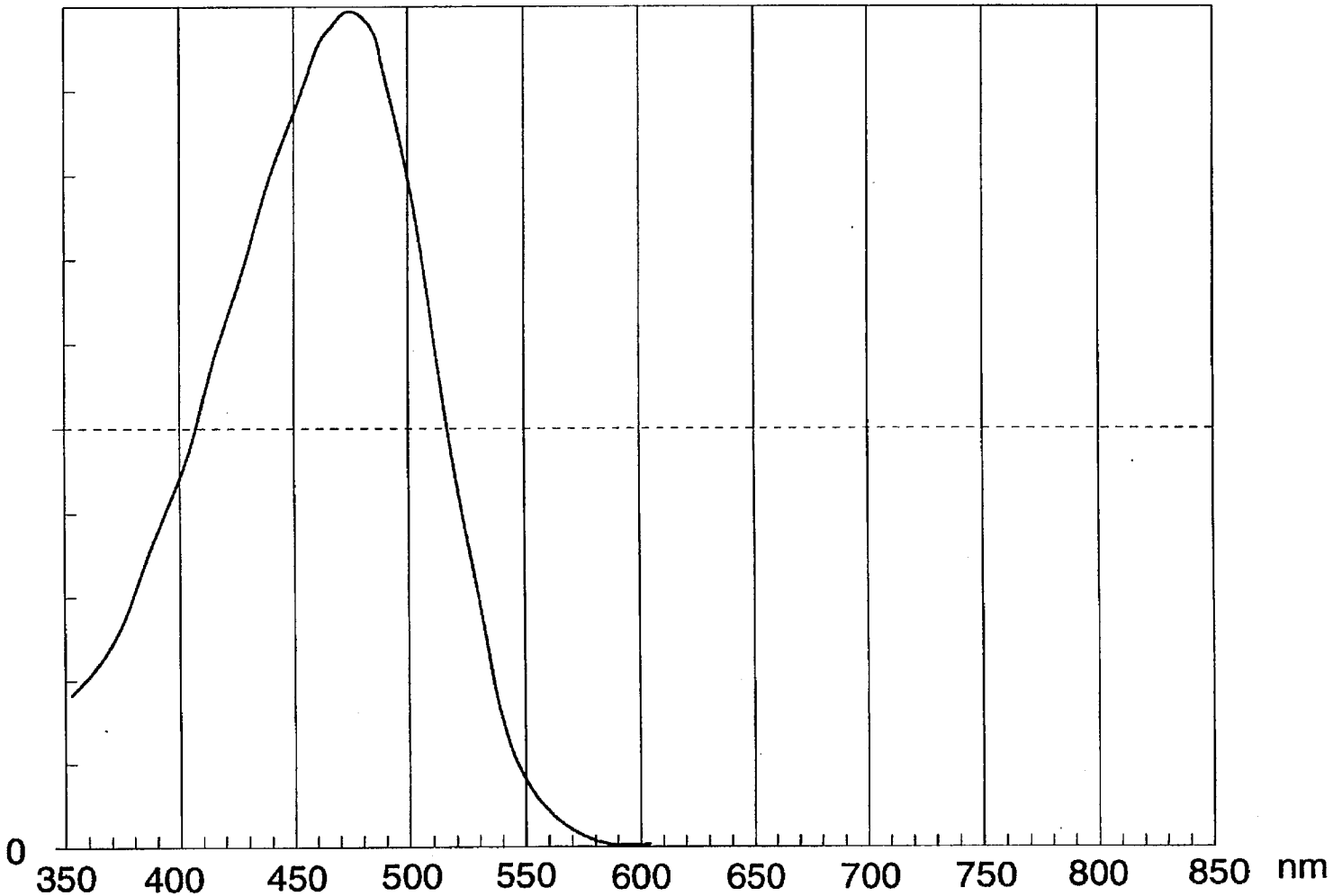
FIG. 8 is a transmission absorption spectrum of another yellow dye.
Figure 9:
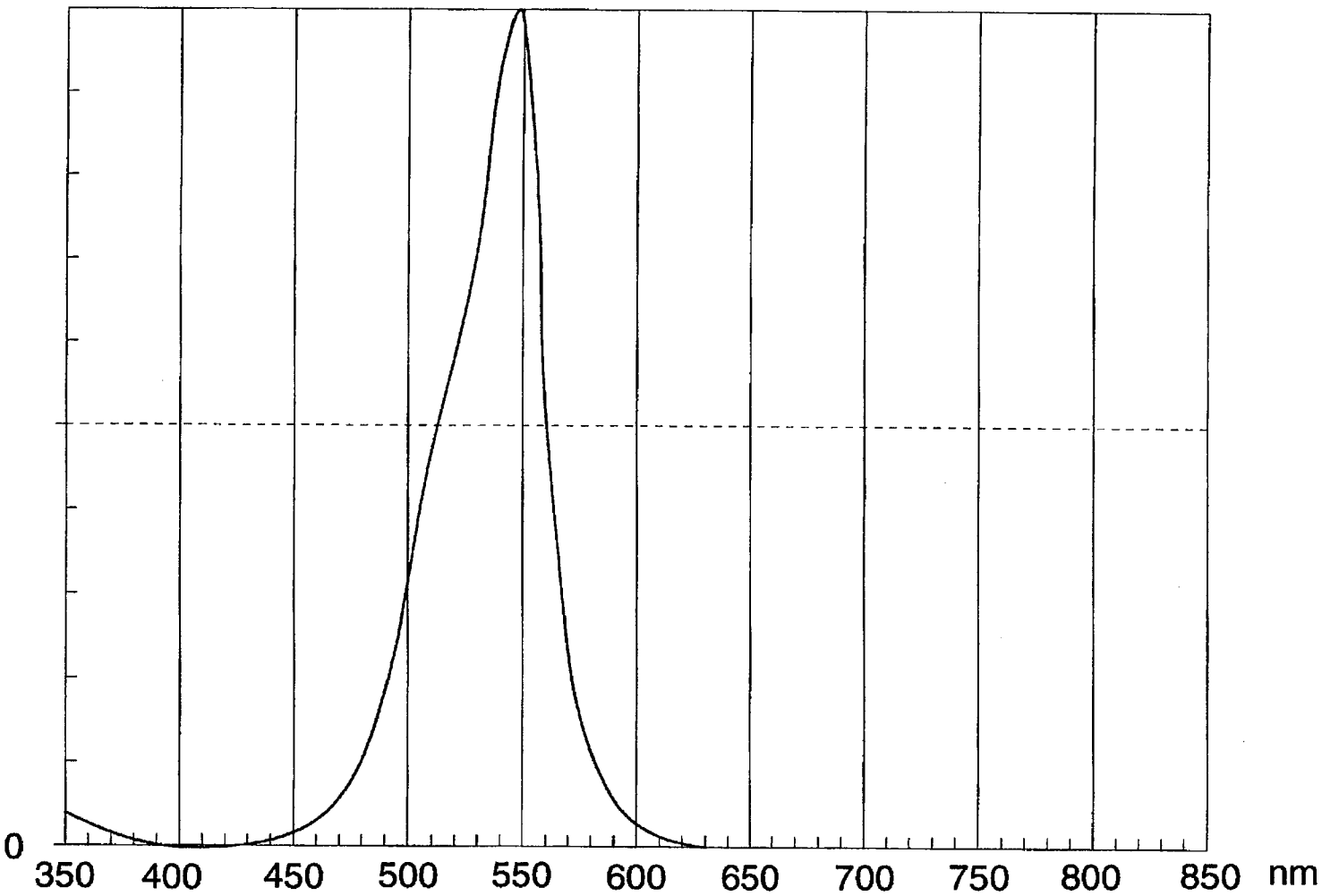
FIG. 9 is a transmission absorption spectrum of another cyan dye.
Figure 10:
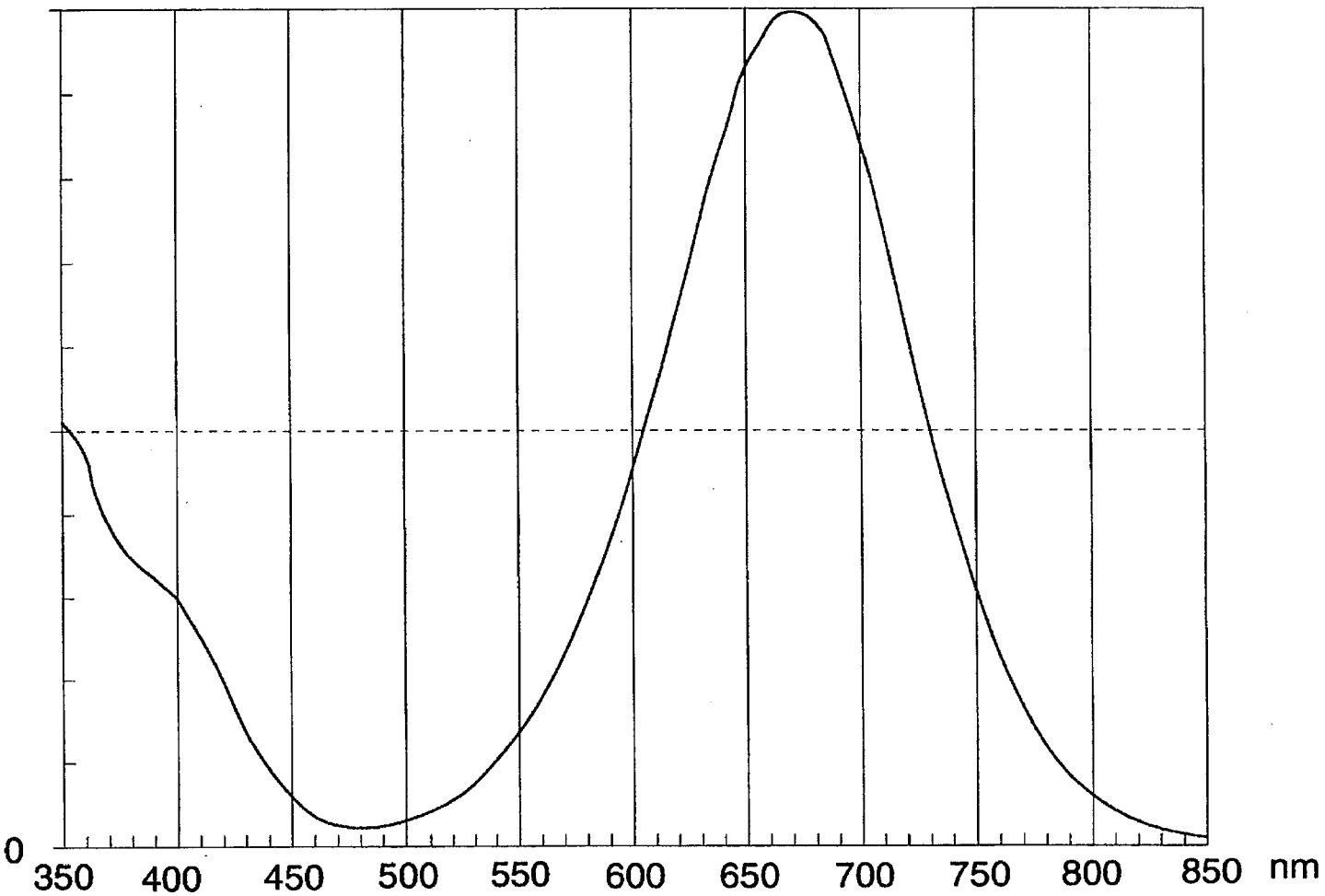
FIG. 10 is a transmission absorption spectrum of another magenta dye.

The transmission absorption spectrum of each dye is shown in FIGS. 8, 9 and 10 respectively.

Figure 4:
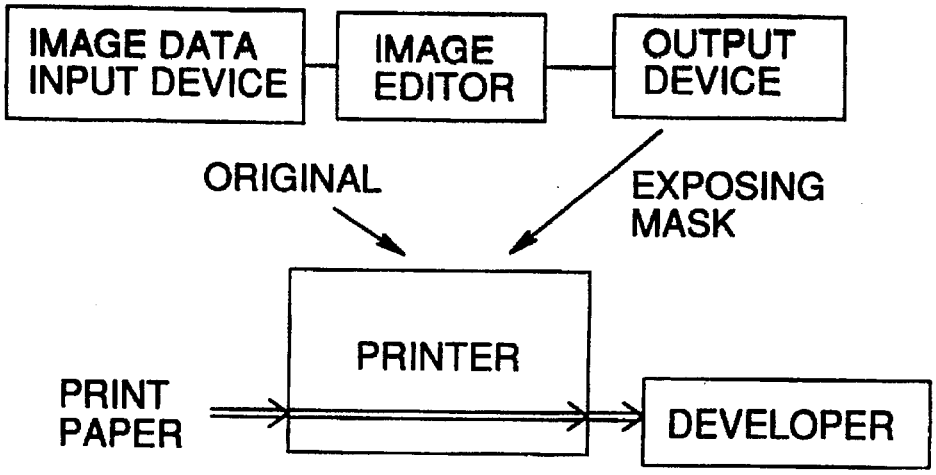
FIG. 4 is a block diagram showing the process of forming a mask for exposure and the construction of the apparatus to print an image on photographic paper.

FIG. 4 is a block diagram showing the process of forming a mask for exposure and the construction of the apparatus to print an image on photographic paper. Numeral 11 is an input section to which a scanner, video camera, MO, CD-ROM and electron type still camera can be applied. Inputted data is edited in an image editing section 12. The image editing section 12 includes a computer, data memory and editing program. Edited data is outputted from an output printer in the form of a mask for exposure. Not only a sublimation type thermal transfer printer but also a fusion type thermal transfer printer, ink jet printer and electronic photographic printer are used for the output printer.

EXAMPLE

With reference to an example, the present invention will be explained more specifically.

A transparent receiving layer was coated on a polyethylene terephthalate (PET) film, the thickness of which was 100 μm so as to form a transparent image receiving sheet.

Next, an ink sheet was formed in the following manner. The reverse surface of a PET film of 6 μm thickness was subjected to heat-resistant treatment. On the front of the PET film, ink compositions including the dyes of yellow, cyan and magenta were successively coated and dried.

Next, using the sublimation type thermal transfer printer shown in FIG. 3, a mask for exposure of a negative film was made in the following manner:

An image receiving sheet and ink sheet were set on the printer. When the sheets were heated by the thermal head in accordance with image data, each dye on the ink sheet was transferred onto the image receiving layer on the image receiving sheet.

Figure 5:
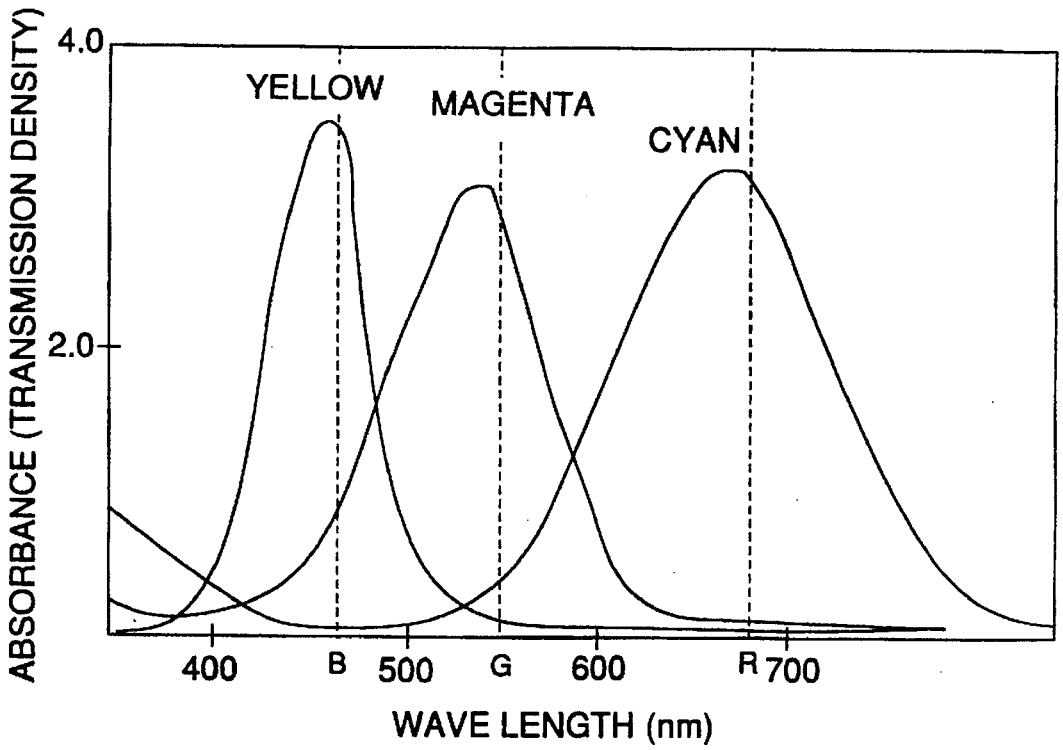
FIG. 5 is a light transmission absorption spectrum of yellow, cyan and magenta of the mask for exposure made by the present invention.

Light transmission absorption spectrums of yellow, cyan and magenta of the mask for exposure made in this manner are shown in FIG. 5. The spectral photometer U3300 manufactured by Hitachi Co. was used for the measuring apparatus. In these spectrums, absorption of the support of the image receiving sheet is excluded.

Figure 6:
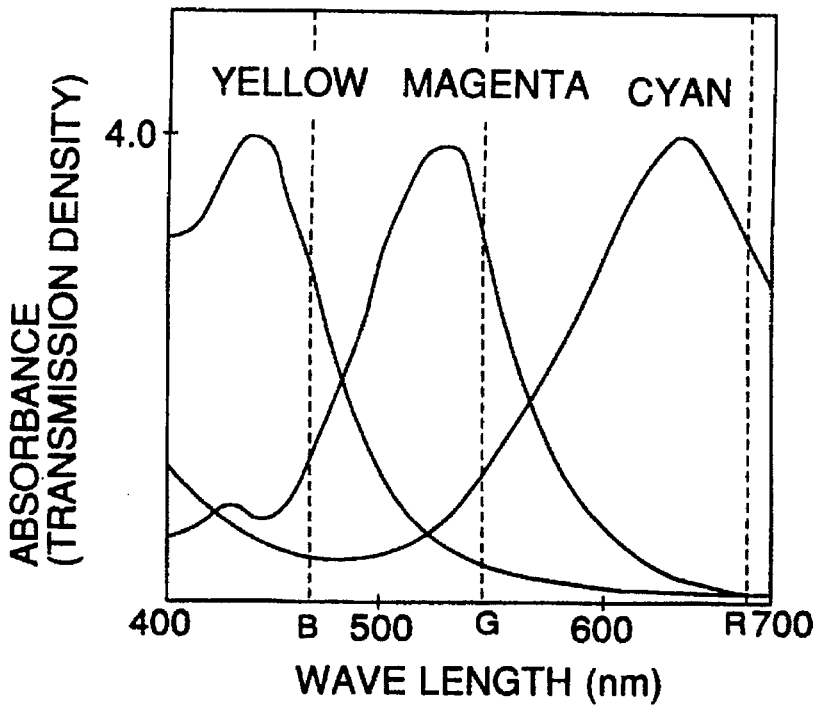
FIG. 6 is a light transmission spectrum of yellow, cyan and magenta of the mask for exposure (Konica Clear QA) made of silver salt photosensitive material.

As a comparative example, FIG. 6 shows a light transmission spectrum of Konica Clear QA, which is a silver halide color photosensitive material, wherein the same measuring method as that described above was used.

Konica QA paper was used as the negative photographic paper. The wavelengths at the maximum regular (blue), orthochromatic (green) and panchromatic (red) spectral sensitivities were respectively 470 nm, 550 nm and 690 nm. In this case, measurement was conducted by a common method.

A mask for exposure, which was made to be used as QA paper, was set on the printer (Konica 5N3), the construction of which is illustrated in FIG. 7, then an image of the mask was printed on photographic paper and developed.

As a comparative example, a mask for exposure made by the Konica Clear QA was used, and the same printer was used. Then an image was printed on photographic paper in the same manner. After development, the image quality was compared. As a result of the comparison, in the case of the developed image which was printed using the mask of the comparative example, the white ground was in a good condition, however, the image tone was not so good. On the other hand, in the case of the developed image which was printed using the mask of the example of the present invention, the white ground was in a good condition, and the image tone was good.

On Table 1, the physical properties of the mask for exposure made by the present invention, and those made by the comparative Konica Clear QA are shown.

TABLE 1

| | Transmission density | | | Amount of irregular absorption of Y | | Amount of irregular absorption of C | |
|---|---|---|---|---|---|---|---|
| | | | | O Peak | P Peak | R Peak | O Peak |
| Mask | Y | M | C | 550 nm | 690 nm | 470 nm | 550 nm |
| Present invention | 2.3 | 2.5 | 2.2 | 4% | 1% | 2% | 16% |
| Konica Clear QA | 2.0 | 2.5 | 2.0 | 7% | 1% | 7% | 22% |

Y: Yellow M: Magenta C: Cyan
O: Orthochromatic P: Panchromatic R: Regular

An extent of influence of the aforementioned amount of irregular absorption will be explained as follows, referring to the example of cyan. An amount of irregular absorption of R peak which is 2% (present invention) when the absorption density of cyan is 2.0 means that the absorption density is 0.04 and that which is 7% (Konica Clear QA, comparative) means that the absorption density is 0.14, showing that the difference between them is 0.1. On the linear portion of the characteristics curve of Konica QA paper for each of exposure amount and density, when the density on a mask changes by 0.1, the density on a print changes by about 0.3. Therefore, the difference of 0.1 mentioned above is very great.

The transmission density of yellow, magenta and cyan of the mask for exposure with respect to the regular, orthochromatic and panchromatic spectral sensitivities of Konica QA paper, can be evaluated by the transmission density measurement in the status M mode of the density meter X Wright manufactured by X Wright Co. Adjustment was executed so that the density of each color became 2.0 to 2.5.

An image on a silver halide photographic print was read using a scanner. Using a computer and a compiling program, illustrations and characters were added to the image, and then a mask for exposure of a negative film was made using a sublimation type thermal transfer printer.

This mask for exposure and Konica QA paper were set on a printer, and the mask image was printed on photographic paper. After that, the image was developed and put on a post card, so that a synthesized image in which a natural image, illustration and character were synthesized, was formed on the post card.

Since the image processing was executed in the process of compiling the data of the mask for exposure so that the gradation of the natural image portion became soft at the point of time of printing and so that the gradation of the illustration character portion became hard, a synthesized image of high quality having high color reproducing property was provided with respect to the natural image and illustrations and characters.

Next, in the same manner, the logotype of a corporation was read using a scanner. Using a computer and a compiling program, characters were added to the image, and then a mask for exposure of a negative film was made using a sublimation type thermal transfer printer.

A silver salt photographic negative film was set in the primary exposure section of a printer, and the mask for exposure made in the manner described above was set in the subsidiary exposure section. Then both images were printed on Konica QA photographic paper. After that, the printed image was developed, so that a collective photograph having color illustrations and characters was made. Even in this case, composite images with high image quality and excellent color reproduction quality were obtained for natural images, illustrations and characters.

The present invention can provide the following effects: According to the mask for exposure of the present invention, an image having a good color reproducing property can be formed on photographic paper. When the mask for exposure is made by the sublimation type thermal transfer system adopting the digital image forming system by which the gradation can be simply controlled, an image of high quality can be formed in photographic paper using one mask, irrespective of the type of an image.

We claim:

1. An image forming method comprising the steps of:

exposing a silver halide color photographic material having a blue, green and red sensitive silver halide emulsion layer to light through a mask, said mask having an image formed with thermal diffusible yellow, magenta and cyan dyes, and processing the exposed silver halide color photographic material by a color developing process, wherein the light absorbance of each of the yellow, magenta and cyan dyes in said mask at, respectively, each of the wavelengths of maximum spectral sensitivity of blue, green and red in the silver halide emulsion is not less than 80% of the maximum light absorbance of each of the yellow, magenta and cyan dyes in said mask.

2. The method of claim 1, wherein the light absorbance of the cyan dye at each of the wavelengths of maximum spectral sensitivity of red, green and blue in the silver halide emulsion layers is, respectively, not less than 80%, not more than 20% and not more than 5% of the maximum light absorbance of the cyan dye.

3. The method of claim 1, wherein the light absorbance of the yellow dye at each of the wavelengths of maximum spectral sensitivity of blue, green and red in the silver halide emulsion layers is, respectively, not less than 80%, not more than 5% and not more than 5% of the maximum light absorbance of the yellow dye.

4. The method of claim 1, wherein:

the light absorbance of the cyan dye at each of the wavelengths of maximum spectral sensitivity of blue and green in the silver halide emulsion layers is, respectively, not more than 5% and not more than 20% of the maximum light absorbance of the cyan dye, and the light absorbance of the yellow dye at the wavelengths of maximum sensitivity of green and red in the silver halide emulsion layers is, respectively, not more than 20% and not more than 5% of the maximum light absorbance of the yellow dye.

5. The method of claim 1, wherein the mask is formed by a thermal diffusion transfer process.

6. (Amended) The method of claim 1, wherein the image of said mask contains characters, illustration and a natural image.

7. The method of claim 1, wherein said thermal diffusible yellow, magenta and cyan dyes are sublimate.

8. The method of claim 1, further comprising a step of exposing said silver halide color photographic material to light through a silver salt negative film concurrently with said exposure of said silver halide photographic material to light through said mask.

* * * * *